US008733262B2

(12) United States Patent
Noguchi et al.

(10) Patent No.: US 8,733,262 B2
(45) Date of Patent: May 27, 2014

(54) NEEDLE THREAD PASSING DEVICE

(75) Inventors: Yoshio Noguchi, Kawagoe (JP); Juri Saito, Kawagoe (JP)

(73) Assignees: Kotobuki & Co., Ltd., Kawagoe-Shi, Saitama (JP); Westek International Corporation, Tokyo (JP)

( * ) Notice: Subject to any disclaimer, the term of this patent is extended or adjusted under 35 U.S.C. 154(b) by 886 days.

(21) Appl. No.: 12/736,115

(22) PCT Filed: Mar. 10, 2009

(86) PCT No.: PCT/JP2009/054527
§ 371 (c)(1),
(2), (4) Date: Sep. 10, 2010

(87) PCT Pub. No.: WO2009/113529
PCT Pub. Date: Sep. 17, 2009

(65) Prior Publication Data

US 2011/0000414 A1 Jan. 6, 2011

(30) Foreign Application Priority Data

Mar. 10, 2008 (JP) ..... 2008-060327

(51) Int. Cl.
*D05B 87/00* (2006.01)

(52) U.S. Cl.
USPC ..... 112/224

(58) Field of Classification Search
USPC ..... 112/224, 225, 226, 227, 302; 223/1, 99
See application file for complete search history.

(56) References Cited

U.S. PATENT DOCUMENTS 2,490,882 A * 12/1949 Pinkham et al. ..... 223/99
2,591,146 A * 4/1952 Gearhart ..... 223/99

(Continued)

FOREIGN PATENT DOCUMENTS

CN 2051234 U 1/1990
CN 2444972 Y 8/2001

(Continued)

OTHER PUBLICATIONS

Japanese Office Action dated Oct. 30, 2012.

(Continued)

*Primary Examiner* — Tejash Patel
(74) *Attorney, Agent, or Firm* — McGinn IP Law Group, PLLC

(57) ABSTRACT

A needle thread passing device is capable of being constructed in a small size for easy storage.
A needle receiving member 34 has a needle insertion hole 34*c* and a thread insertion slit 34*e* forming an angle with the needle insertion hole 34*c*. A needle threader member 42 is movable between positions away from and close to the needle receiving member 34 and has a needle threader pin 48*b* that can push a thread inserted through the thread insertion slit 34*e* into a needle eye 52*a* of a needle 52 inserted into the needle insertion hole 34*c* when the needle threader member 42 moves from the position away from the needle receiving member 34 to position close thereto. A cover 32 can move with respect to a main body 30 containing the needle receiving member 34. The needle threader member 42 is constantly biased toward the position away from the needle receiving member 34. The cover 32 can move between a locking position at which the needle threader member 42 is locked to the position close to the needle receiving member 34 and an allowable position at which the needle threader member is allowed to move between the positions away from and close to the needle receiving member. At the storage time, the cover is located at the locking position.

20 Claims, 17 Drawing Sheets

(56) References Cited

U.S. PATENT DOCUMENTS

| | | | | | |
|---|---|---|---|---|---|
| 2,747,778 | A | * | 5/1956 | Balzer | 223/99 |
| 2,777,623 | A | * | 1/1957 | Balzer | 223/99 |
| 4,461,409 | A | * | 7/1984 | Biemans | 223/99 |
| 4,557,408 | A | * | 12/1985 | Biemans | 223/99 |
| 4,911,341 | A | * | 3/1990 | Davis | 223/99 |
| 5,251,797 | A | * | 10/1993 | Martin | 223/99 |
| 6,045,016 | A | * | 4/2000 | Okada | 223/99 |
| 6,830,165 | B2 | | 12/2004 | Tanaka | |

FOREIGN PATENT DOCUMENTS

| | | | |
|---|---|---|---|
| CN | 1480578 | A | 3/2004 |
| EP | 1 388 602 | A2 | 3/2003 |
| EP | 1 388 602 | A3 | 3/2003 |
| GB | 1 465 696 | | 2/1977 |
| JP | 37-14676 | | 8/1958 |
| JP | 60-24311 | | 2/1985 |
| JP | 3010503 | | 2/1995 |
| JP | 3010503 | U | 5/1995 |
| JP | 3046563 | U | 3/1998 |
| JP | 11-491 | | 1/1999 |
| JP | 11-276754 | A | 10/1999 |
| JP | 3315364 | | 6/2002 |

OTHER PUBLICATIONS

Extended European Search Report dated Feb. 17, 2014.

Communication pursuant to Rules 70 (2) and 70 a(2) EPC, dated Mar. 6, 2014.

* cited by examiner

NEEDLE THREAD PASSING DEVICE

TECHNICAL FIELD

The present invention relates to a needle thread passing device for facilitating insertion of an end of a thread in the eye of a needle.

BACKGROUND ART

As a needle thread passing device of such a type, one disclosed in Patent Documents 1 (Japanese Patent No. 3,315,364) is known. In this needle thread passing device, a needle insertion cylinder having a bottomed needle insertion hole is placed upright on a main body having a pedestal surface, and a thread passing hole to be communicated with a needle eye of an inserted needle is formed in a lower portion of the needle insertion cylinder in a direction crossing the needle insertion hole. A thread placement portion is formed near the entrance of the thread passing hole, and a thread locking piece is provided at an operating member provided in the main body. The thread locking piece is configured to be freely inserted into and removed from the thread passing hole through the operating member by a pressing force of a pressing member provided in the main body. In this configuration, a needle is inserted into the needle insertion hole of the needle insertion cylinder, a thread is set at the thread placement portion, and the pressing member is pressed. Then, the operating member is swung. As a result, the thread locking piece provided in the operating member pulls the thread set at the thread placement portion into the thread passing hole, whereby the thread is inserted into the needle eye. When the pressing force of the pressing member is released, the operating member swung back by a spring to its original position. As a result, the thread is passed through the needle eye.

Patent Documents 1: Japanese Patent No. 3315364

SUMMARY OF THE INVENTION

Technical Problem

However, in the needle thread passing device of Japanese Patent No. 3,315,364, a space for the operating member to swing is provided in the main body and thereby the size of the main body is increased. As a result, the apparatus takes up much space, leading to inconvenience for storage.

The present invention has been made in view of the above problem, and an object thereof is to provide a needle thread passing device capable of being constructed in a small size for easy storage.

Solution to Problem

To attain the above object, according to an aspect of the present invention, there is provided a needle thread passing device including a needle receiving member formed with a needle insertion hole and a thread insertion slit forming an angle with the needle insertion hole, a needle threader member that is movable between positions away from and close to the needle receiving member and has a needle threader pin that can push a thread inserted through the thread insertion slit into an eye of a needle inserted into the needle insertion hole when the needle threader member moves from the position away from the needle receiving member to position close thereto, and a changeover member that can move with respect to the needle receiving member. The needle threader member is constantly biased toward the position away from the needle receiving member, and the changeover member can move between a locking position at which the needle threader member is locked to the position close to the needle receiving member and an allowable position at which the needle threader member is allowed to move between the positions away from and close to the needle receiving member.

When the changeover member is located at the locking position, the needle threader member is locked at a position close to the needle receiving member, so that at the time of nonuse, the needle thread passing device can be made in a compact form for easy storage. At the time of use, the changeover member is moved to the allowable position so as to allow movement of the needle threader member. Thus, the needle threader member can automatically move to the position away from the needle receiving member by the biasing force. After a needle and thread are inserted into the needle insertion hole and thread insertion slit, respectively, the needle threader member is moved against the biasing force, thereby allowing the thread to be pushed into a needle eye by the needle threader pin. Thus, the needle threader member is made movable only at the time of use, and the needle thread passing device can be made in a compact form at the time of nonuse.

The needle threader member can swing so as to allow the tip end thereof to move between the positions away from and close to the needle receiving member, and the changeover member can comprise a cover that covers at least a part of the needle threader member at the locking position.

When the cover covers at least a part of the swingable needle threader member, the swing of the needle threader member can be disabled.

The needle receiving member can be arranged in a cylindrical main body, the changeover member can be slid on the outside of the main body, and at least a part of the needle threader member can be arranged in the main body when located at the position close to the needle receiving member.

Since at least a part of the needle receiving member and the needle threader member can be housed in the cylindrical main body at the time of nonuse, the needle thread passing device can be in made in a compact form, achieving easier storage.

A housing space may be formed between the main body and the needle receiving member.

Since the housing space can be formed between the main body and the needle receiving member, a needle thread passing device can provide high space efficiency and excellent storage capability.

A magnet may be arranged at the end portion of the needle insertion hole. Because a needle that has been inserted into the needle insertion hole is attracted by the magnet, the needle can be fixed in place, thereby preventing dropping of the needle.

The thread insertion slit may extend from the outside surface of the needle receiving member in the direction inclined with respect to the needle insertion hole, and then may extend toward the needle insertion hole in the direction perpendicular to the needle insertion hole.

Because the thread insertion slit extends in the direction perpendicular to the needle insertion hole at a position close to the needle insertion hole, it is sufficient for the thread inserted through the thread insertion slit to reach the portion extending in the direction perpendicular to the needle insertion hole in order for the thread to be pushed into the needle eye by the needle threader pin.

The needle thread passing device may be constructed by integrating a needle thread passing unit including the needle receiving member, the needle threader member, and the changeover member and a unit having a different function from that of the needle thread passing unit.

The size of the needle thread passing device can be reduced, so that it is possible to realize a needle thread passing device by integrating the needle thread passing unit with another unit having a different function from that of the needle thread passing unit.

The needle receiving member may further comprise a protecting member for guiding the movement of the needle threader pin. It can prevent the thin needle threader pin from being broken or bent when the needle threader member is inserted into the needle hole as the needle threader member can move from the position away from the needle receiving member to the position close thereto.

The protecting member may be deformable while the needle threader member approaches the needle receiving member so as to allow approach of the needle threader member. Due to deformation of the protecting member, the interference of the protecting member for guiding the movement of the needle threader pin can be prevented at when the needle threader member approaches the needle receiving member.

A notifying means for generating a sound or friction force may be provided between the needle receiving member and the needle threader member, which is produced while the needle threader pin of the needle threader member is passing through the needle insertion hole. The user of may recognize the completion of the movement operation of the needle threader member by the notifying means.

The needle threader member comprises a pair of needle threader supporting parts and a needle threader part including the needle threader pin arranged between the threader supporting parts. One of the needle threader supporting parts may include an axis pivotally supported by the needle receiving member and the other of the needle threader supporting parts may include a cut out portion at a location corresponding to the axis.

To assemble the needle threader member to the needle receiving member, when inserting the pivot provided on the one of the needle threader supporting parts into the needle receiving member, the cut out portion provided on the other of the needle threader supporting parts can avoid interference with the needle receiving member, which facilitates the assembling operation.

REFERENCE SIGNS LIST

Figure 1:
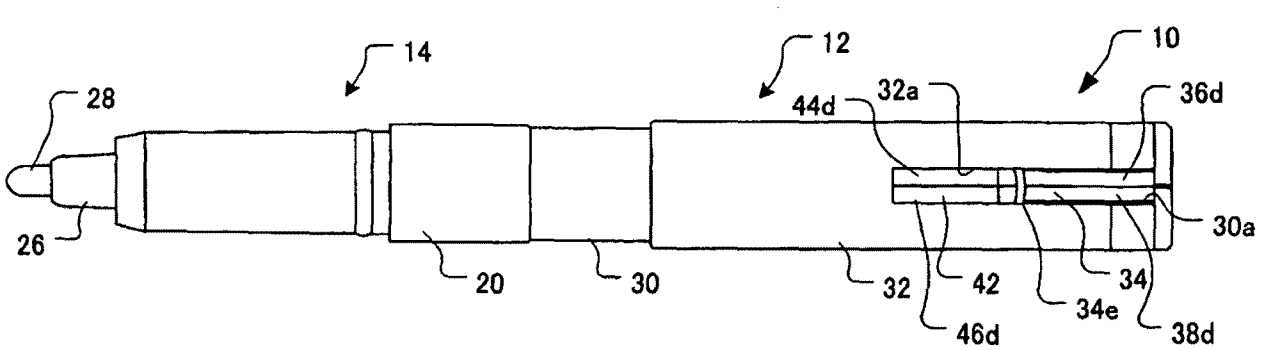
FIG. 1 is an entire view of a needle thread passing device according to a first embodiment of the present invention in a storage state.

10, 10', 100 needle thread passing device
12, 112 needle thread passing unit
14 writing unit (function unit)
30 main body
32, 132 cover (changeover member)
34, 34', 134 needle receiving member
34*c*, 134*c* needle insertion hole
34*e*, 134*e* thread insertion slit
40, 140 magnet
42, 142 needle threader member
48*b*, 148*b* needle threader pin
52 needle
52*a* needle eye
54 thread
60, 62 container (function unit)
90 housing space
144, 146 needle threader supporting parts
144*c* pivot
146*c* cut portion
152 protecting cover (protecting member)
152*d* small projections (notifying means)

DESCRIPTION OF EMBODIMENTS

Embodiments of the present invention will be described below with reference to the accompanying drawings.

Figure 2:
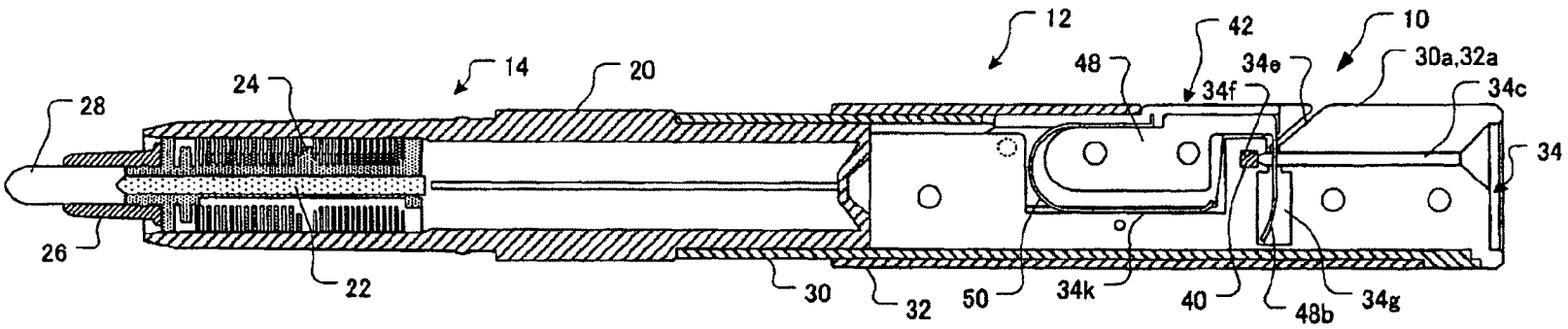
FIG. 2 is a lengthwise cross-sectional view of the needle thread passing device of FIG. 1 in a storage state.
Figure 3:
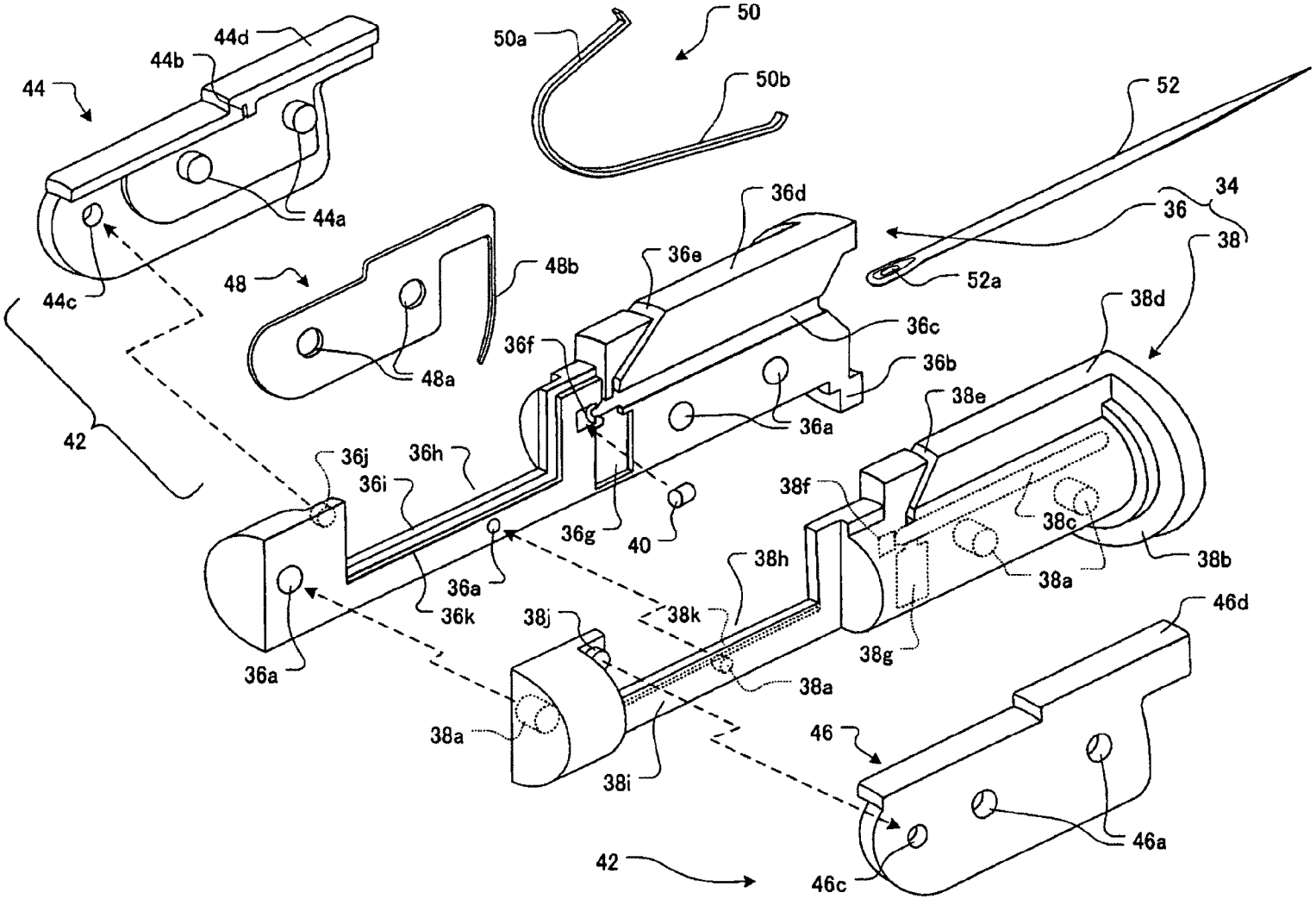
FIG. 3 is an exploded perspective view of the inside of the needle thread passing device of FIG. 1.

FIG. 1 is an entire view of a needle thread passing device according to a first embodiment of the present invention in a storage state, FIG. 2 is a vertical cross-sectional view thereof in a storage time, and FIG. 3 is an exploded perspective view of the inside thereof.

As illustrated, a needle thread passing device 10 according to the first embodiment has an elongated cylindrical shape as a whole. The needle thread passing device 10 includes a needle threader unit 12 provided on one side of the needle thread passing device 10 and a writing unit 14 provided on the other side thereof. The needle thread passing unit 12 and the writing unit 14 are connected to each other in the axial direction to constitute the needle thread passing device 10. The both units may be connected to each other by any suitable method, such as press fitting, bonding, screwing or like in a detachable or fixed manner. As a matter of course, the needle thread passing device 10 may be constituted only by the needle thread passing unit 12. However, in this embodiment, a use of the writing unit 14 enables writing on fabrics.

The writing unit 14 includes a writing unit main body 20 constituting an ink tank, a relay core 22, an adjuster 24 constructed in an comb-like shape for housing overflow ink, a tip element 26, a pen point 28, and a not-shown cap detachably attached to the pen point 28 so as to protect the same. The writing unit 14 may have any suitable configuration other than as illustrated or described herein.

The needle thread passing unit 12 includes a cylindrical main body 30 connected to the writing unit main body 20 of the writing unit 14 and a cover 32 which is a cylindrical changeover member covering the outside of the main body 30 and freely slidable in a predetermined range with respect to the main body 30 in the axial direction thereof. Elongated holes 30*a* and 32*a* are formed on the main body 30 and the cover 32, respectively, at positions aligned in the circumferential direction thereof so as to extend from the end portions thereof in the axis direction.

In the following description, as a matter of convenience, the writing unit 14 side of the needle thread passing unit 12 is referred to as proximal side, and its opposite side is referred to as distal side.

A needle receiving member 34 is arranged in the main body 30 so as to extend from the distal end side thereof. As shown in FIG. 3, the needle receiving member 34 is constituted by two needle receiving parts 36 and 38 which are substantially symmetric with respect to each other. A plurality of engagement projections 38*a* projecting from the needle receiving part 38 are fitted into a plurality of engagement holes 36*a* formed in the needle receiving part 36, whereby the substantially cylindrical needle receiving member 34 provided in the main body 30 is constructed. The needle receiving member 34 is fixed by press fitting, engagement, bonding or like in the main body 30.

Flange portions 36*b* and 38*b* are formed respectively at the distal ends of the needle receiving parts 36 and 38 so as to be abutted against the tip end surface of the main body 30.

Elongated groove portions 36*c* and 38*c* are formed respectively on the opposed surfaces of the needle receiving parts 36 and 38 so as to extend from the distal side. In a state where the needle receiving parts 36 and 38 has been fitted to each other to constitute the needle receiving member 34, the elongated groove portions 36*c* and 38*c* constitute a needle insertion hole 34*c* (see FIG. 2) for receiving a needle.

Projecting portions 36*d* and 38*d* partly projecting outward in the circumferential direction are formed in the needle receiving parts 36 and 38. In a state where the needle receiving parts 36 and 38 has fitted to each other to constitute the needle receiving member 34, a slight gap is formed between the opposed surfaces of the projecting portions 36*d* and 38*d*. This gap extends to the inside in the radial direction so as to communicate with the needle insertion hole 34*c*. Further, the projecting portions 36*d* and 38*d* slightly project from the elongated holes 30*a* and 32*a* of the main body 30 and the cover 32 and are therefore exposed.

Slits 36*e* and 38*e* are formed so as to obliquely extend from exposed surfaces of the projecting portions 36*d* and 38*d*. The slits 36*e* and 38*e* extend from the exposed surfaces toward the proximal side and then extend in the direction perpendicular to the needle insertion hole 34*c* constituted by the elongated groove portions 36*c* and 38*c*. The slits 36*e* and 38*e* constitute a thread insertion slit 34*e*(see FIG. 2). Housing grooves 36*f* and 38*f* are formed at the end portions, i.e., adjacent to the proximal end portions of the elongated groove portions 36*c* and 38*c*. The housing grooves 36*f* and 38*f* constitute a magnet housing portion 34*f* (see FIG. 2). A magnet 40 is housed in the magnet housing portion 34*f*.

Concave portions 36*g* and 38*g* are formed in the needle receiving parts 36 and 38 so as to extend from the end portions of the elongated groove portions 36*c* and 38*c* in the direction perpendicular to the elongated groove portions 36*c* and 38*c* and in the direction opposite to the projecting portions 36*d* and 38*d*. In a state where the needle receiving parts 36 and 38 has been fitted to each other to constitute the needle receiving member 34, the concave portions 36*g* and 38*g* constitute a thread pass hole 34*g* (see FIG. 2).

Cut out portions 36*h* and 38*h* are formed on the proximal side relative to the projecting portions 36*d* and 38*d*. The cut out portions 36*h* and 38*h* are surrounded by thin plate-like portions 36*i* and 38*i*. Pivots 36*j* and 38*j* are formed so as to project from the proximal end portions of the plate-like portions 36*i* and 38*i*. Lower top portions 36*k* and 38*k* are formed on the top surface of the plate-like portions 36*i* and 38*i*. The heights of the lower top portions 36*k* and 38*k* are lower at the opposed side than at the opposite side. The lower top portions 36*k* and 38*k* constitute a spring receiving surface 34K.

A needle threader member 42 is arranged so as to sandwich the plate-like portions 36*i* and 38*i*. The needle threader member 42 is constituted by two needle threader supporting parts 44 and 46 having substantially the same shape, a needle threader part 48 sandwiched by the needle threader supporting parts 44 and 46, and a spring 50 serving as a biasing member. A plurality of engagement holes 48*a* formed in the needle threader part 48 and a plurality of engagement holes 46*a* formed in the needle threader supporting part 46 are fitted to a plurality of engagement projections 44*a* formed on the needle threader supporting part 44, whereby the needle threader supporting parts 44 and 46 constitute the outer shape of the needle threader member 42 with the needle threader part 48 sandwiched therebetween. A needle threader pin 48*b* is formed at the needle threader part 48 so as to project from between the needle threader supporting parts 44 and 46.

The spring 50 has one leg 50*a* and the other leg 50*b* forming an angle and is elastically deformable so as to allow the angle to be changed. The leg 50*a* of the spring 50 is arranged along a groove 44*b* formed in the needle threader supporting part 44 to be sandwiched between the needle threader supporting parts 44 and 46.

Pivot receiving holes 44*c* and 46*c* are formed respectively in the needle threader supporting parts 44 and 46 which are pivotably fitted to the pivots 36*j* and 38*j* of the needle receiving parts 36 and 38. Thus, the needle threader supporting parts 44 and 46 are arranged adjacent to the plate-like portions 36*i* and 38*i* of the needle receiving parts 36 and 38, the needle threader part 48 and spring 50 are arranged in the cut out portions 36*h* and 38*h* of the needle receiving parts 36 and 38, and the leg 50*b* of the spring 50 is abutted against the spring receiving surface 34*k*. This arrangement allows the needle threader member 42 to be swingable about the pivots 36*j* and 38*j* with respect to the needle receiving member 34. That is, the needle threader member 42 can move between the positions at which the tip end thereof is away from and close to the needle receiving member 34. Further, in this arrangement, the tip end of the needle threader member 42 is biased by the spring 50 in the direction away from the needle receiving member 34. When swinging, the needle threader member 42 can pass through the elongated hole 30*a* of the main body 30.

Further, while the needle threader member 42 swings from a position at which the tip end thereof is away from the needle receiving member 34 to a position close to the same, the needle threader pin 48*b* of the needle threader part 48 can go into the gap formed between the opposed surfaces of the projecting portions 36*d* and 38*d* of the needle receiving parts 36 and 38 and pass through the proximal end portions of the elongated groove portions 36*c* and 38*c* constituting the needle insertion hole 34*c* so as to reach the concave portions 36*g* and 38*g* constituting the thread pass hole 34*g*, and can go back along the same route.

When the needle threader member 42 is brought close to the needle receiving member 34 to the maximum extent possible, against the biasing force of the spring 50, projecting portions 44*d* and 46*d* formed at the distal ends of the needle threader supporting parts 44 and 46 so as to project in the radial direction and distal end direction are aligned with the projecting portions 36*d* and 38*d* of the needle receiving parts 36 and 38.

At the time of nonuse, in the needle thread passing unit 12 having the above configuration, the cover 32 is located at a position (locking position) at which the same covers the proximal end portion of the elongated hole 30*a* of the main body 30 as shown in FIG. 2. Thus, parts other than the projecting portions 44*d* and 46*d* of the needle threader supporting parts 44 and 46 constituting the needle threader member 42 are covered by the cover 32. In this state, the biasing force of the spring 50 is intercepted by the cover 32, so that the needle threader member 42 is locked at a position close to the needle receiving member 34 to be housed in the main body 30, forming a cylindrical shape together with the needle receiving member 34. Therefore, the needle thread passing unit 12 can be housed compactly in this state. At this time, the tip end of the needle threader pin 48*b* of the needle threader part 48 reaches the thread pass hole 34*g*, as shown in FIG. 2.

Figure 4:
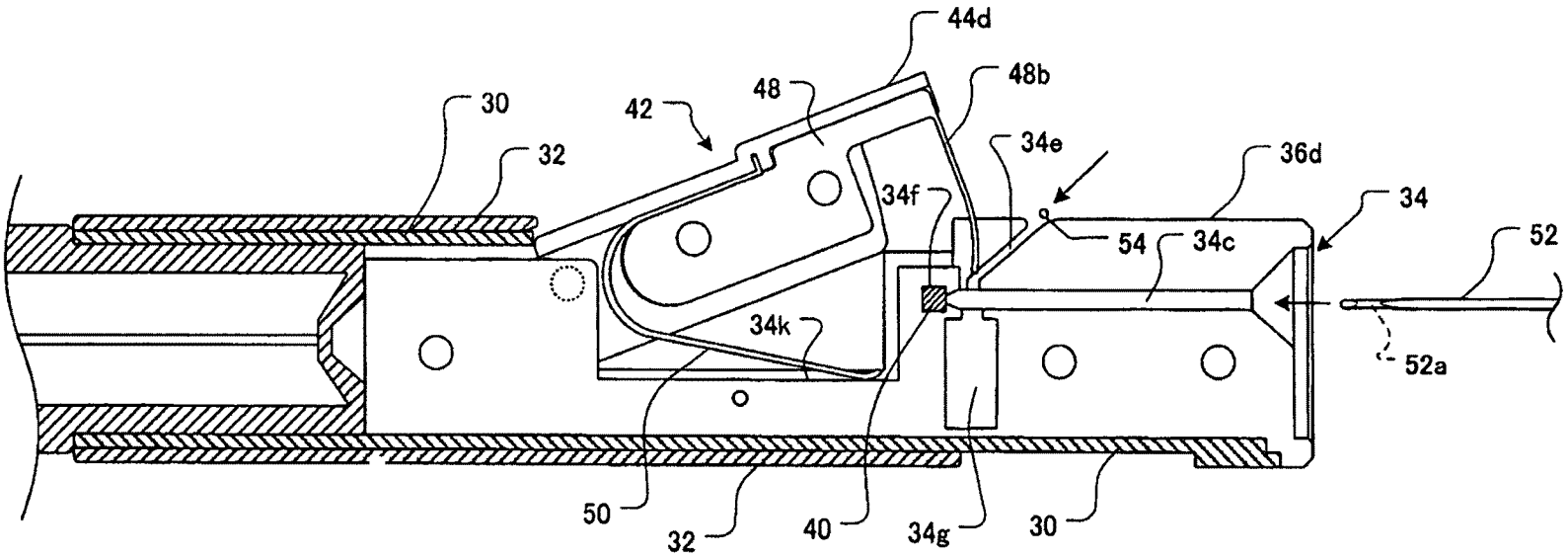
FIG. 4 is a lengthwise cross-sectional view of a main portion of the needle thread passing device of FIG. 1 at the time of use.

At the time of use, the cover 32 is slid to a position (allowance position) on the proximal end side relative to the main body 30. As a result, the needle threader member 42 goes out of the cover 32, allowing the needle threader member 42 to swing outwardly by the biasing force of the spring 50 (FIG. 4). Accordingly, the tip end of the needle threader pin 48*b* of the needle threader part 48 passes through the thread pass hole 34*g* and the needle insertion hole 34*c* and stops at the gap between the projecting portions 36*d* and 38*d*.

Figure 5:
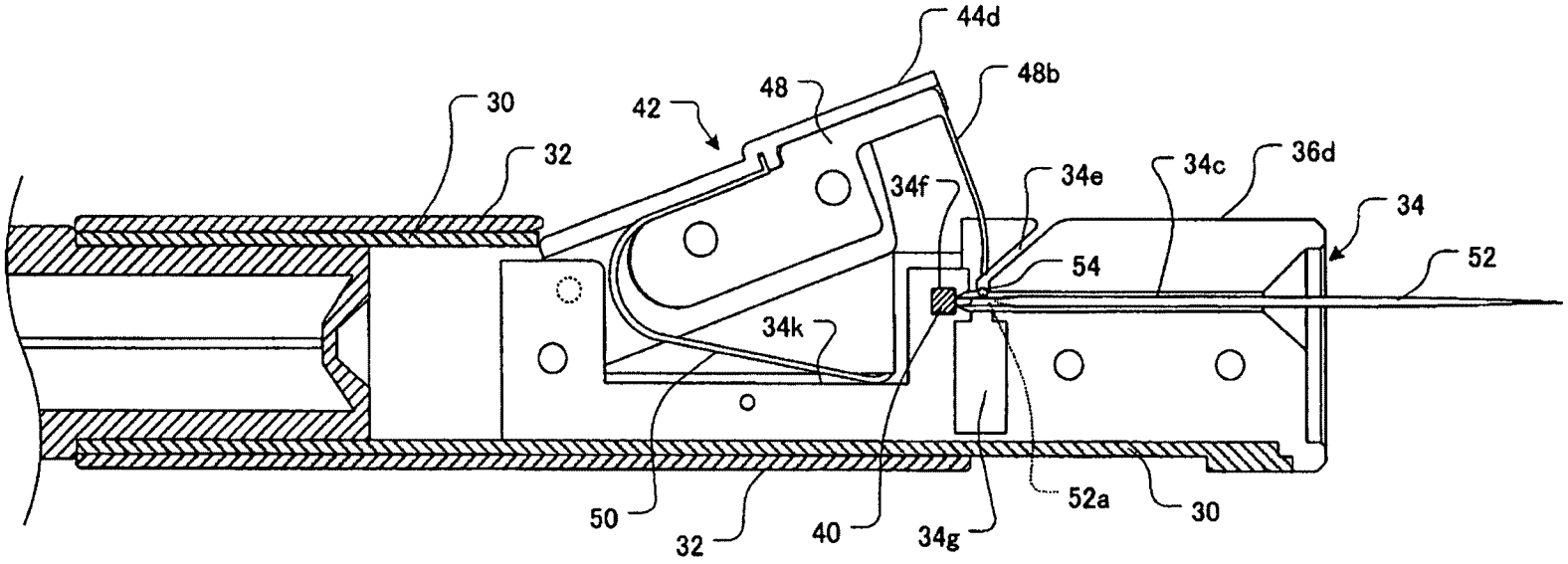
FIG. 5 is a lengthwise cross-sectional view of a main portion of the needle thread passing device of FIG. 1 at the time of use.

Then, as shown in FIG. 5, a needle 52 is inserted into the needle insertion hole 34*c* with a needle eye 52*a* directed to the needle insertion hole 34*c*. When the needle 52 has been inserted into deeply into the needle insertion hole 34*c*, the needle 52 is attracted to the magnet 40 by the magnetic force thereof, so that the needle 52 can be fixed in place, thereby preventing dropping of the needle 52.

Then, a thread 54 is inserted into the inside of the needle thread passing unit 12 through a thread insertion slit 34*e*. The position of the end portion of the thread insertion slit 34*e* is set corresponding to the position of the needle eye 52*a*. The end portion of the thread insertion slit 34*e* extends in the direction perpendicular to the needle insertion hole 34*c*. That is, it is sufficient for the thread 54 to reach the portion extending in the direction perpendicular to the needle insertion hole 34*c*, not necessarily reach just the end portion of the thread insertion slit 34*e*.

Figure 6:
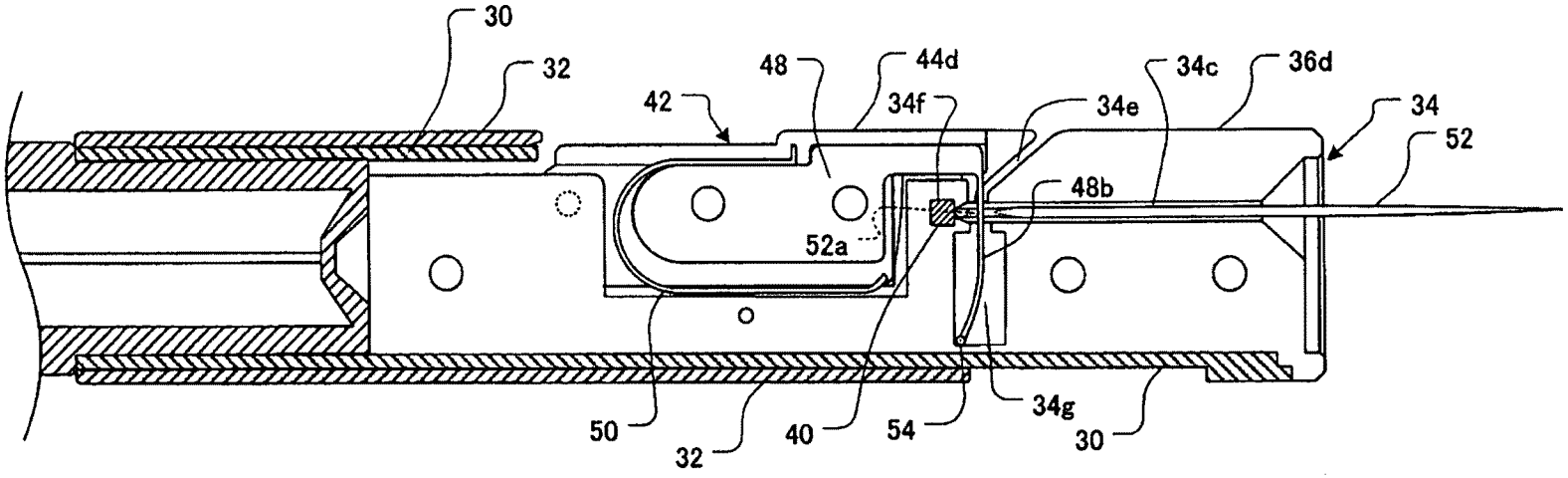
FIG. 6 is a lengthwise cross-sectional view of a main portion of the needle thread passing device of FIG. 1 at the time of use.

Then, when the needle threader member 42 is pressed so as to allow the same to swing such that the distal ends of the projecting portions 44*d* and 46*d* of the needle threader supporting parts 44 and 46 are brought close to the needle receiving member 34, the tip end of the needle threader pin 48*b* of the needle threader part 48 passes through the needle eye 52*a* while pressing the thread and reaches the thread pass hole 34*g* as shown in FIG. 6. When the pressing of the needle threader member 42 is released, the needle threader pin 48*b* goes out of the needle eye 52*a*, while a state where the thread 54 has been inserted through the needle eye 52*a* is kept.

Figure 7:
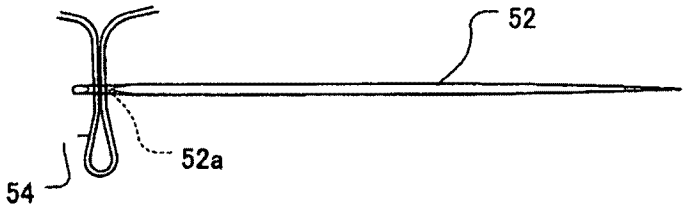
FIG. 7 shows a state where a thread has been inserted through a needle eye.

When the needle 52 is taken out of the needle insertion hole 34*c*, a part of the thread 54 is kept inserted through the needle eye 52*a*. The thread that has been inserted through the needle eye 52*a* has a loop as shown in FIG. 7, so that when the loop is made larger until the end of the thread 54 passes through the needle eye 52*a*, the loop is released, whereby the needle insertion operation is completed.

After the use, the needle threader member 42 is pressed to bring the distal ends of the projecting portions 44*d* and 46*d* of the needle threader supporting parts 44 and 46 close to the needle receiving member 34 and, after that, the cover 32 is moved to the locking position, whereby the needle threader can be made in a compact form once again.

As described above, according to the first embodiment of the present invention, its operation can be achieved with the needle threader in hand at the time of use, while at the time of nonuse, the needle thread passing device can be made in a compact form for easy storage.

Figure 8:
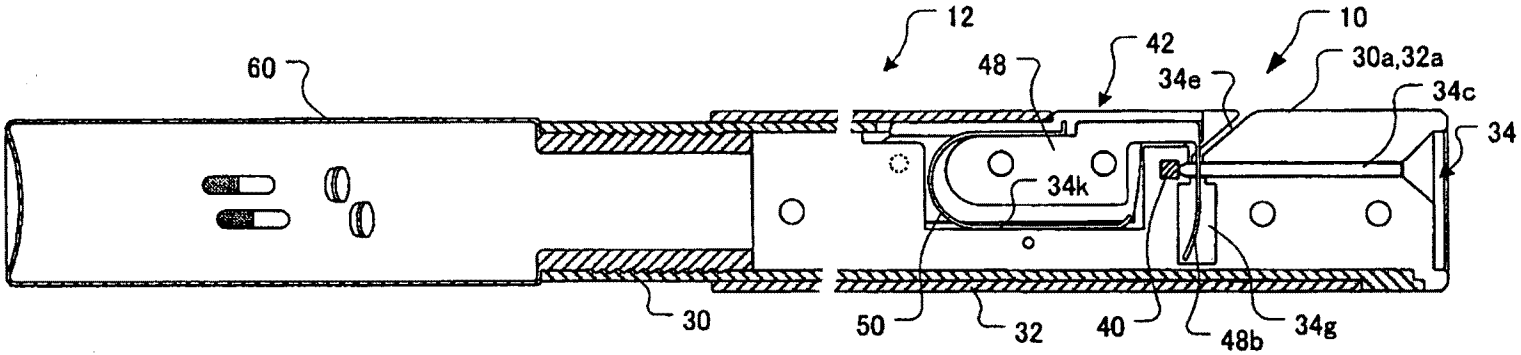
FIG. 8 is a lengthwise cross-sectional view showing a modification in which a unit different from the writing unit is integrated with the needle thread passing unit in the axial direction to constitute the needle thread passing device according to the present invention.
Figure 9:
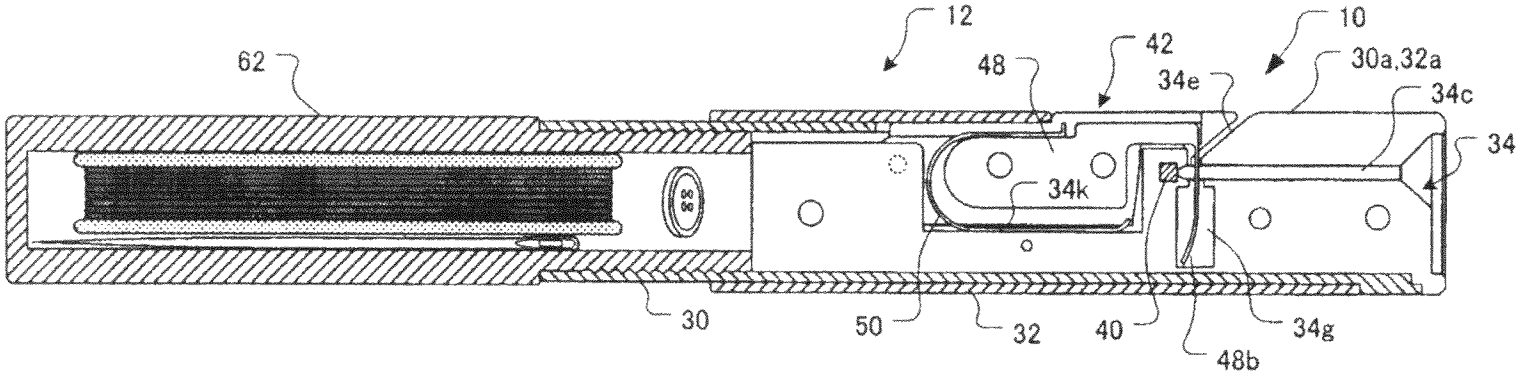
FIG. 9 is a lengthwise cross-sectional view showing another modification in which a unit different from the writing unit is integrated with the needle thread passing unit in the axial direction to constitute the needle thread passing device according to the present invention.
Figure 10:
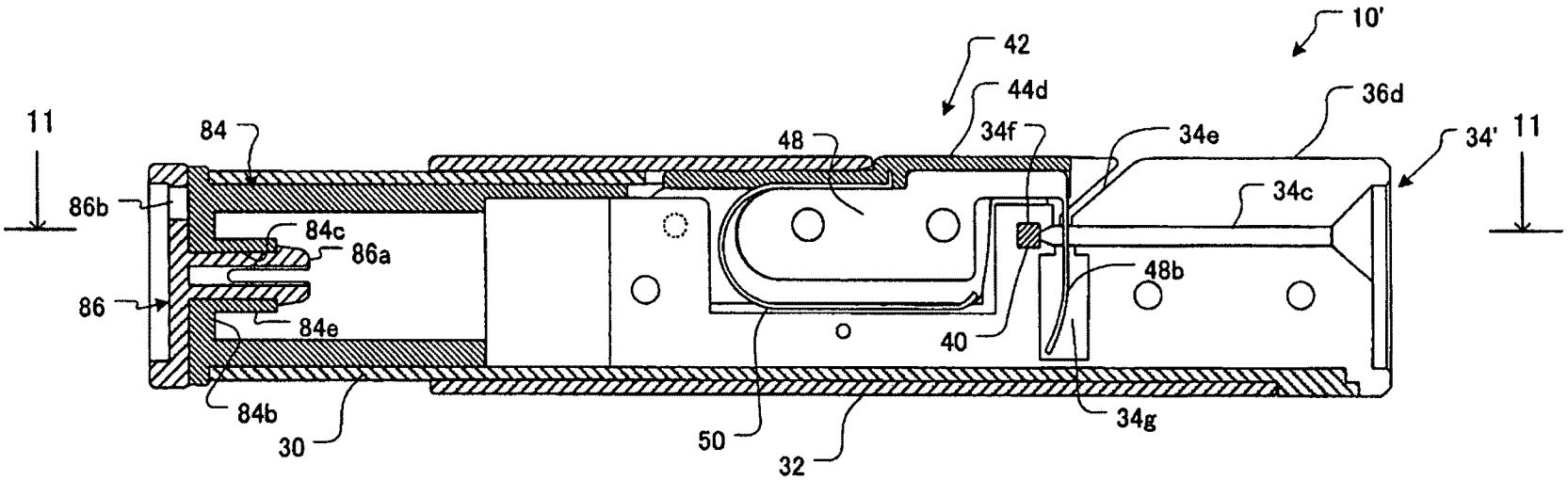
FIG. 10 is a lengthwise cross-sectional view of a needle thread passing device according to a second embodiment of the present invention in a storage state.

FIGS. 8 and 9 each show a modification in which the needle thread passing unit 12 and a function unit different from the writing unit 14 are integrated in the axial direction to constitute the needle thread passing device 10. In FIGS. 8 and 9, containers 60 and 62 are used as the units to be integrated with the needle thread passing unit 12. Although the containers 60 and 62 are each detachably connected to the main body 30 by screwing in these examples, the connecting method is not limited to this. The container 60 is formed by blow molding and the container 62 is formed by injection molding. A user can put various objects such as pills, threads, needles, or buttons in the container 60 or 62. These objects can be taken out by removing the container 60 or 62 from the main body 30.

FIGS. 10 to 14 are views showing a needle thread passing device according to a second embodiment of the present invention. A needle thread passing device 10' in the present embodiment does not have a plurality of units but instead, integrally has a housing space inside the needle thread passing device. In the present embodiment, the same reference numerals as those in the first embodiment denote the same or corresponding parts as those in the first embodiment, and the descriptions thereof will be omitted here.

The needle threader passing device 10' includes a cylindrical main body 30, a cover 32 which is a cylindrical changeover member covering the outside of the main body 30 and freely slidable in a predetermined range with respect to the main body 30 in the axial direction thereof, a needle receiving member 34', a needle threader member 42, a tail cap 84 which is inserted into the main body 30 from the proximal end side (rear side) and fixed therein, and a dial 86 which is rotatably attached to the tail cap 84.

Figure 11:
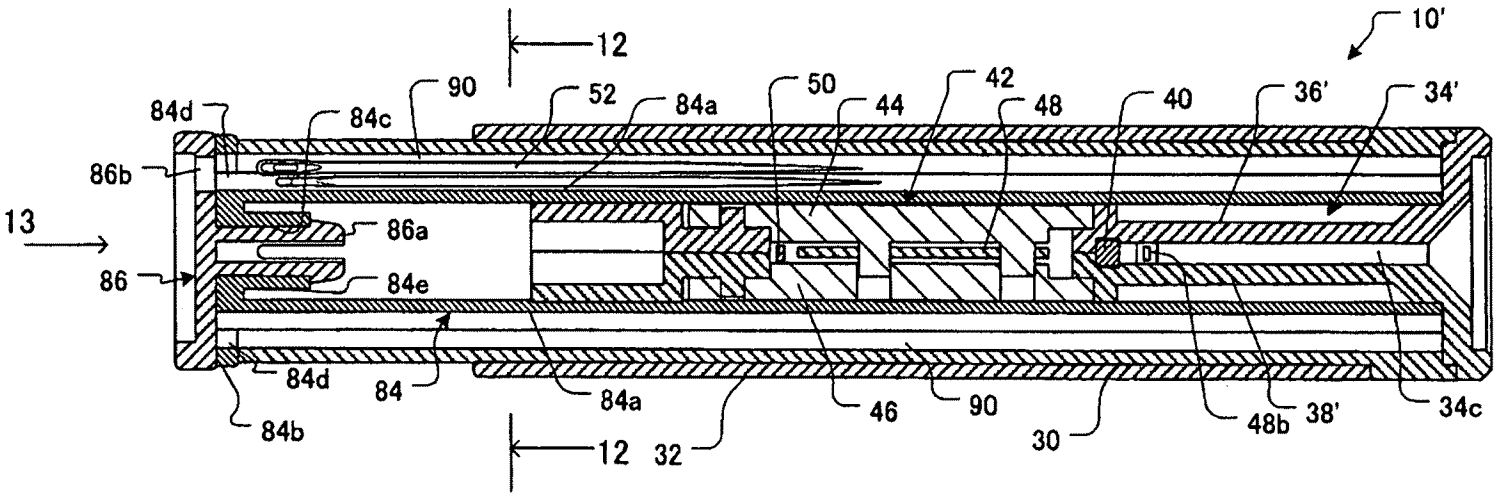
FIG. 11 is a cross-sectional view taken along the line 11-11 of FIG. 10.
Figure 12:
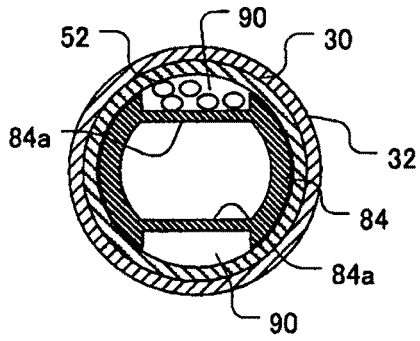
FIG. 12 is a lateral cross-sectional view taken along the line 12-12 of FIG. 11.

As shown in FIG. 11, needle receiving parts 36' and 38' constituting the needle receiving member 34' do not expand in the radial direction, but a gap is formed between the main body 30 and the needle receiving parts 36' and 38', and a pair of wall surface portions 84*a* and 84*a* extending in the direction toward the tail cap 84 are arranged on both sides of the needle receiving member 34', whereby housing spaces 90 extending in the axial direction are defined between the wall surface portions 84*a* and the inner circumferential surface of the main body 30.

The tail cap 84 and the needle receiving member 34' may be fixed to the main body 30 by any suitable method such as engagement, fitting, press fitting, or like.

The tail cap 84 has a rear end surface portion 84*b* for closing the rear end of the main body 30. The rear end surface portion 84*b* has a center hole 84*c* at its center and a flange portion 84*e* surrounding the periphery of the center hole 84*c*. The rear end surface portion 84*b* of the tail cap 84 further has a pair of insertion ports 84*d* and 84*d* which are eccentrically arranged from the center hole 84*c* so as to communicate with the housing spaces 90.

The dial 86 is attached to the rear end surface portion 84*b* of the tail cap 84. A boss portion 86*a* of the dial 86 is inserted into the center hole 84*c* of the tail cap 84 to be rotatably engaged with the tip end of the flange portion 84*e*. The dial 86 has, at a position eccentrically displaced from the center thereof, a window hole 86*b* which can be aligned with one of the insertion ports 84*d*.

Figure 13:
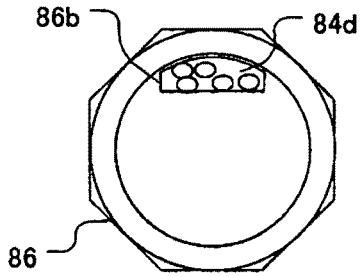
FIG. 13 is a view showing the end surface of the needle thread passing device as viewed in the arrow 13 of FIG. 11.
Figure 14:
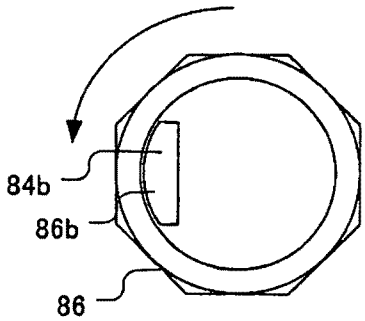
FIG. 14 is a view showing a state where a dial is rotated from the position shown in FIG. 13.

In the needle threader passing device 10' having the above configuration, it is possible to put the needle 52 and the like in the housing spaces 90 defined between the wall surface portions 84*a* of the tail cap 84 and the inner circumferential surface of the main body 30. When the needle 52 and the like are put in or taken out, the dial 86 is rotated so as to align the window hole 86*b* of the dial 86 with one of the insertion holes 84*d* as shown in FIG. 13, thereby allowing the needle 52 and the like to be put in or take out of the housing space 90. When the dial 86 is rotated after the completion of pulling in or taking out the needle 52 and the like so as to move the window hole 86*b* to a position that is not aligned with the insertion holes 84*d* as shown in FIG. 14, it is possible to prevent dropping of the needle 52 and the like put in the housing spaces 90.

A procedure of inserting the thread through the needle eye is the same as in the needle thread passing unit 12 (FIGS. 4 to 6).

According to the needle thread passing device 10', the housing spaces 90 are provided between the main body and needle receiving member, thereby achieving a needle thread passing device with high space efficiency and excellent portability/accommodation capability.

Further, the needle thread passing device is presented as FIG. 15 to FIG. 20 according to a third embodiment of the present invention.

The needle thread passing unit 112 of the needle thread passing device 100 in this embodiment of the present invention includes the cover 132 which is freely slidable with respect to the needle receiving member 134 and needle threader member 142 which is movable between positions away from and close to needle threader member 134. It may be chosen if having the main body or not having the same. The needle receiving member 134 and the needle threader member 142 are respectively corresponding to the needle receiving member 34, 34' and the needle threader member 42 of the former embodiments.

The needle receiving member 134 includes two needle receiving parts 136, 138 which are substantially symmetric with respect to each other, and also magnet 140, protecting cover 152 and cutter 154.

The needle receiving parts 136 and 138 correspond to the needle receiving parts 36 and 38(36', 38') of the former embodiments, and the both parts respectively include engagement projections 136*a*, engagement hole 138*a*, flange portion 136*b* and 138*b*, elongated groove portions 136*c* and 138*c*, projecting portions 136*d* and 138*d*, slit 136*e* and 138*e*, housing grooves 136*f* and 138*f*, concave portions 136*g* and 138*g*, cut out portions 136*h* and 138*h*, plate-like portions 136*i* and 138*i*, pivot receiving holes 136*j* and 138*j*, which respectively correspond to engagement hole 36*a*, engagement projections 38*a*, flange portion 36*b* and 38*b*, elongated groove portions 36*c* and 38*c*, projecting portions 36*d* and 38*d*, slit 36*e* and 38*e*, housing grooves 36*f* and 38*f*, concave portions 36*g* and 38*g*, cut portions 36*h* and 38*h*, plate-like portions 36*i* and 38*i*, pivots 36*j* and 38*j* of the former embodiments. This arrangement allows needle insertion hole 134*c* to be formed by the elongated groove portions 136*c* and 138*c*, thread insertion slit 134*e* to be formed by the slit 136*e* and 138*e*, magnet housing groove 134*f* to by formed by the housing groove 136*f* and 138*f*, thread pass hole 134*g* to be formed by the concave portions 136*g* and 138*g*.

The needle receiving parts 136 and 138, which are different from the needle receiving parts 36 and 38, have semi cylindrical projections 136*k* and 138*k* in the cut out portions 136*h* and 138*h*, and a spring receiving projection 134*k* is formed by these cylindrical projections 136*k* and 138*k*.

These needle receiving parts 136 and 138 respectively comprise second concave parts 136*m* and 138*m* at the opposite side of the concave parts 136*g* and 138*g* for installing the protecting cover 152 and third concave parts 136*n* and 138*n* at the same side of the concave parts 136*g* and 138*g* for housing the cutter 154 at the concave parts 136*g* and 138*g* as well as the construction of the needle receiving parts 36 and 38.

The protecting cover 152 comprises a pair of legs 152*a* which are largely bent to be U-shaped, and head 152*b* which is slightly bent at the opposite side of the legs 152*a*, and a vertical elongated slit 152*c* is formed at the center of the head 152*b*. The legs 152*a* and 152*a* are attached to the needle receiving parts 136 and 138 so as to pivotably received in a pivoting receiving part formed on the second concave part 136*m* and 138*m* of the receiving parts 136 and 138. The protecting cover 152 is elastically deformable. The bending end part of the head 152*b* has a small projection 152*b*.

While the protecting cover 152 is attached to the needle receiving parts 136 and 138, a gap is formed between the head 152*b* of the protecting cover 152 and the needle receiving parts 136 and 138 so as to communicate with the thread insertion slit 134*e*. This gap and the thread insertion slit 134*e* are widen than the thread insertion slit 34*e* in the former embodiment in order to easily insert a thread.

A needle threader member 142 is arranged to sandwich the plate-like portions 136*i* and 138*i* and is constituted by two needle threader supporting parts 144 and 146 having substantially the same shape, and a needle threader part 148 sandwiched by the needle threader supporting parts 144 and 146. A plurality of engagement holes 148*a* formed in the needle threader part 148 and a plurality of engagement holes 146*a* formed in the needle threader supporting part 146 are fitted to a plurality of engagement projections 144*a* formed on the needle threader supporting part 144, whereby the needle threader supporting parts 144 and 146 constitute the outer shape of the needle threader member 142 with the needle threader part 148 sandwiched therebetween. A needle threader pin 148*b* is formed at the needle threader part 148 projecting from the middle of the needle threader supporting parts 144 and 146.

Pivot 144*c* is formed on one side of the needle threader supporting part 144 which is rotatably fitted to the pivot receiving holes 136*j* and 138*j* of the needle receiving parts 136 and 138.

On the other hand, cut out portion 146*c* is formed in one of the needle threader supporting part 146 so as to correspond to the pivot 144*c* of the needle threader supporting part 144. The spring 150 is inserted between the spring receiving projection 134*k* formed by the projections 136*k* and 138*k* of the needle receiving parts 136 and 138 and the spring receiving parts 144*b* and 146*b* formed in the needle threader supporting parts 144 and 146. Further, falling out stopper lugs 144*e* and 146*e* are formed on the respective opposed faces of the needle threader receiving parts 144 and 146.

Figure 21:
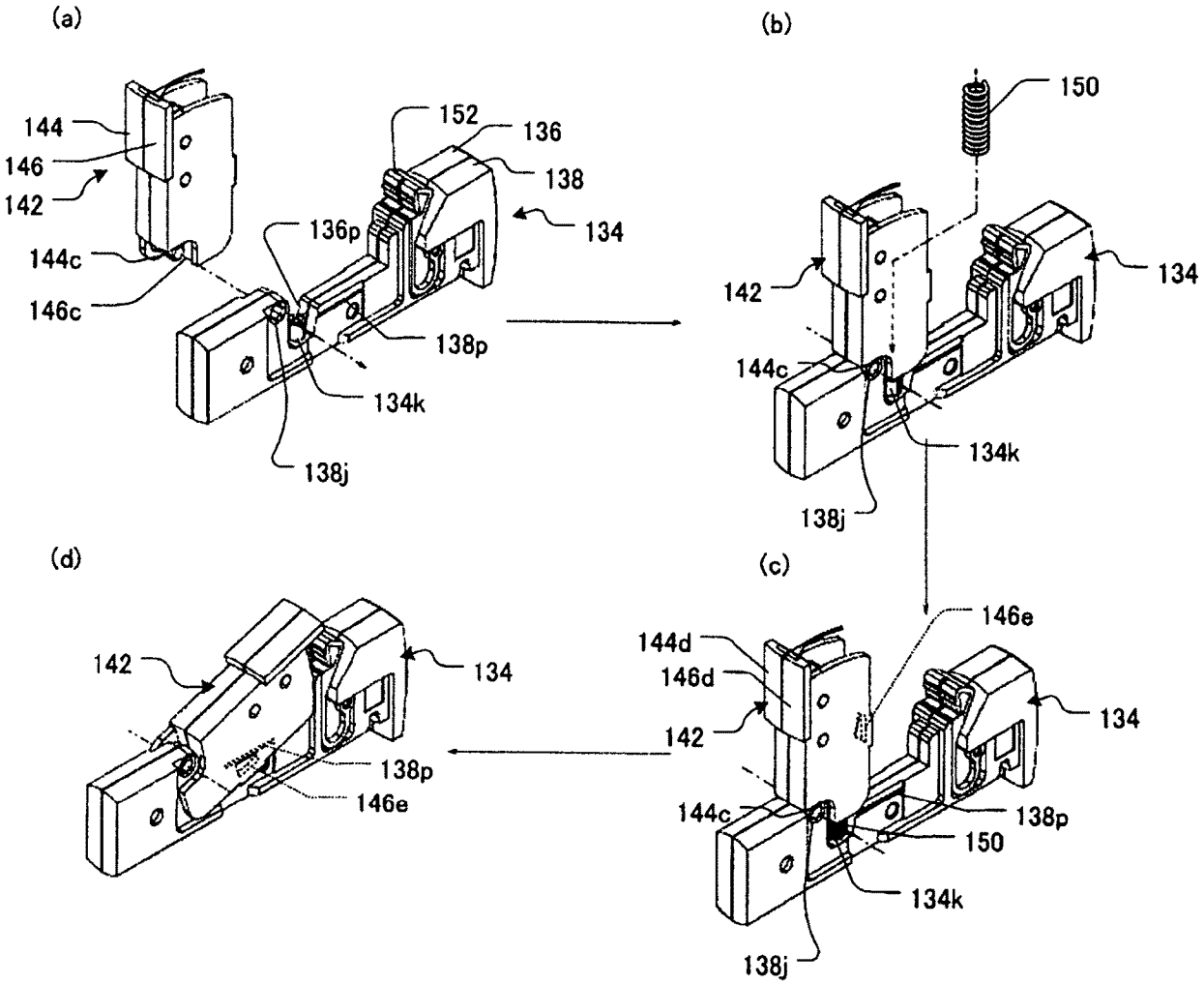
FIG. 21 is a perspective view of installation process of needle threader member of the needle thread passing device, FIG. 15 assembled to needle receiving member.

When installing of the threader member 142 to the needle threader receiving member 134, as shown in FIG. 21(*a*), the pivot 144*c* of the thread passing part 144 is inserted into the pivot receiving holes 136*j* and 138*j* of the needle receiving parts 136 and 138 under the status that the threader member 142 is rotate by 90 degree relative to the needle receiving member 134.

At this installation operation, the corresponding portion to the pivot 144*c* of the needle threader supporting parts 146 is the cut out portion 146*c*, which allows the needle receiving member 134 to pass through the cut out portion 146*c* and the insertion operation of the pivot 144*c* may be operated without interference of the needle threader supporting parts 146. In the next step, the spring 150 is inserted between the needle threader member 142 and the needle receiving member 134 so as to be set between the spring receiving projection 134*k* and the spring receiving parts 144*b* and 146*b* (FIG. 21(*b*)). Further, while the projections 144*d* and 146*d* are close to the needle receiving member 134 by swing the needle threader member 142, the falling out stopper lugs 144*e* and 146*e* of the needle threader supporting parts 144 and 146 respectively pass over the falling out stopper lugs 136*p* and 138*p* formed on the plate-like portions 136*i* and 138*i* of the needle receiving parts 136 and 138, thereby installing the needle threader member 142 to the needle receiving member 134. The falling out stopper lugs 144*e* and 146*e* prevent excess swing of the needle threader member 142 by interfering with the falling out stopper lugs 136*p* and 138*p* once passing over the falling out stopper lugs 136*p* and 138*p* due to the elastic deformation of the needle threader supporting parts 144 and 146.

Accordingly, the needle threader supporting parts 144 and 146 are close to the plate-like portions 136*i* and 138*i* of the needle receiving parts 136 and 138 and the needle threader part 148 and the spring 150 are arranged in the cut out portions 136*h* and 138*h* of the needle receiving parts 136 and 138.

Thus, the needle threader supporting part 142 is allowed to swingable about the pivot receiving holes 136*j* and 138*j* with respect to the needle receiving member 134, that is, the needle threader member 142 can move between the positions at which the tip end thereof is away from and close to the needle receiving member 134. Further, in this arrangement, the tip end of the needle threader member 142 is biased by the spring 150 in the direction away from the needle receiving member 134.

The needle threader pin 148*b* of the needle threader part 148 is inserted into the slit 152*c* of the protecting cover 152 and the surface of the both sides of the needle threader pin 148*b* is sandwiched by the slit 152*c*.

Figure 15:
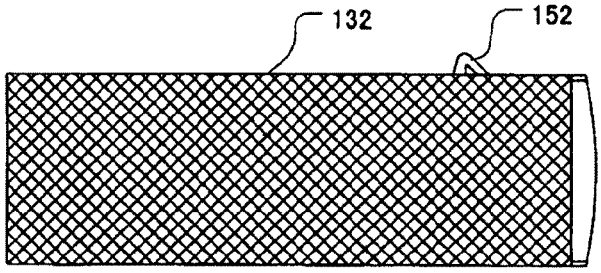
FIG. 15 is an entire view of a needle thread passing device according to a third embodiment of the present invention in a storage state.
Figure 16:
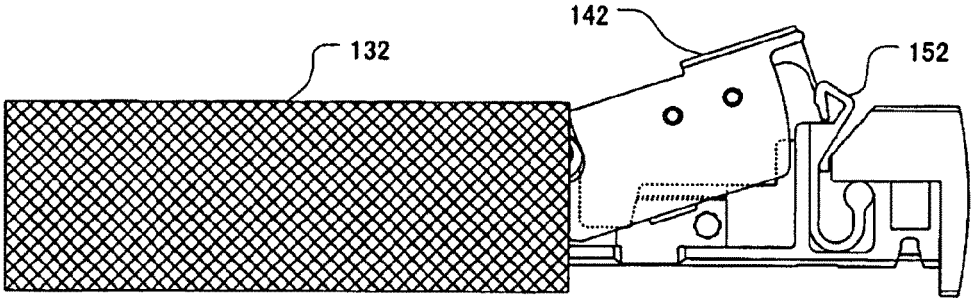
FIG. 16 is an entire view of the needle thread passing device of FIG. 15 at the time of use.
Figure 17:
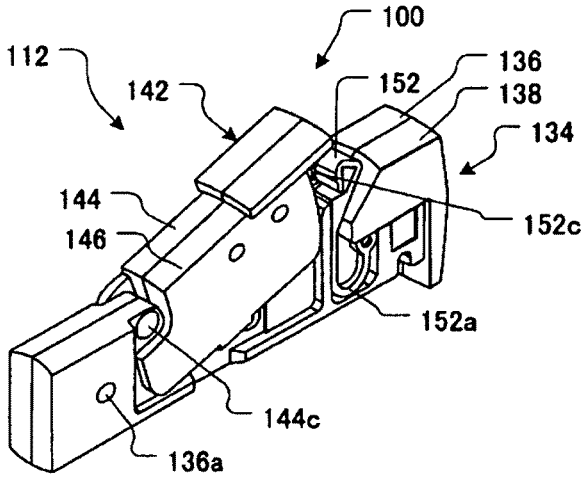
FIG. 17 is a perspective view of a part of the needle thread passing device of FIG. 15.
Figure 18:
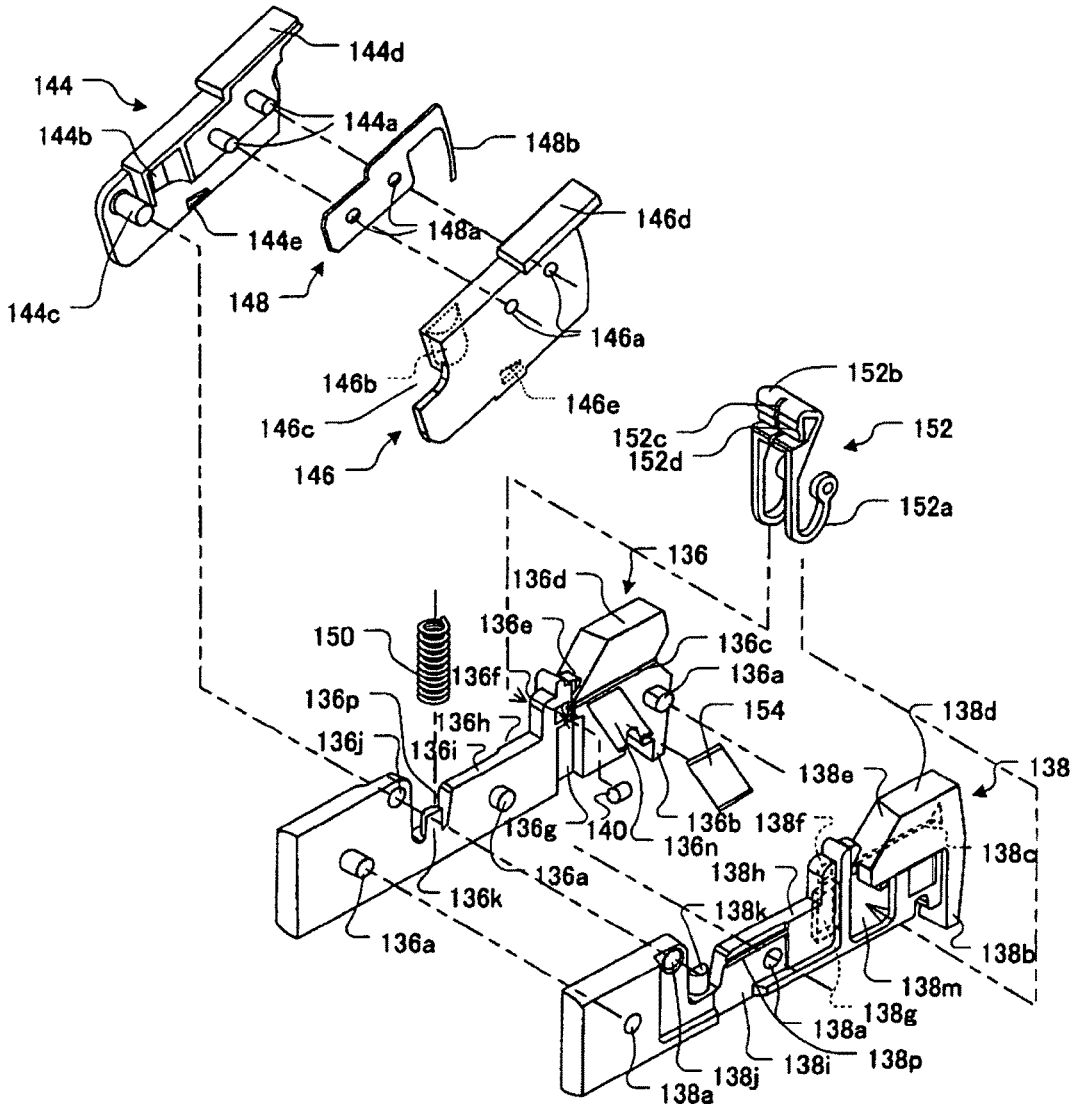
FIG. 18 is an exploded perspective view of a main portion of the needle thread passing device of FIG. 15.
Figure 19:
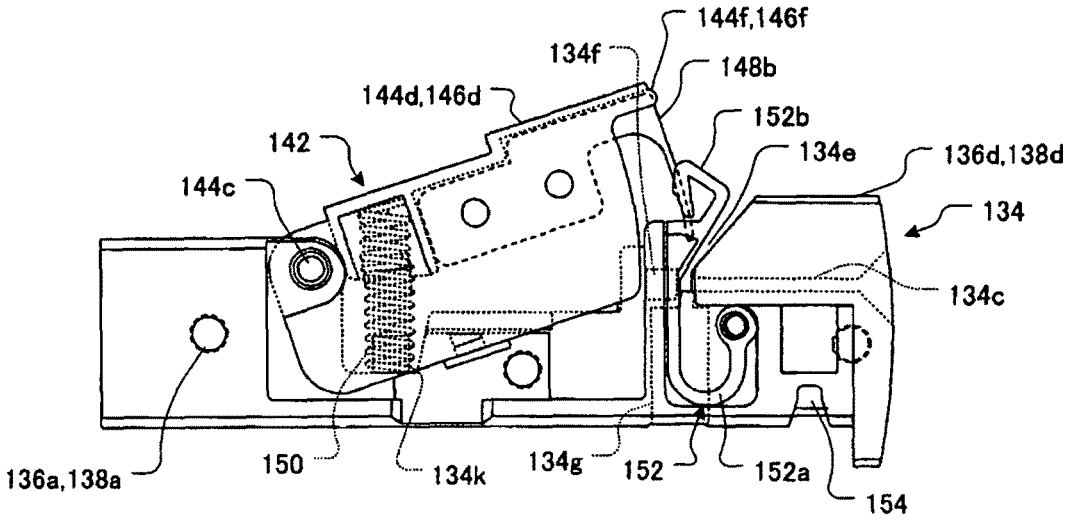
FIG. 19 is a lengthwise cross-sectional view of a main portion of the needle thread passing device of FIG. 15 at the time of use.

At the time of use, in the needle threader unit having the above configuration, while the cover 132 is slid to the needle receiving member 134 from the position as shown in FIG. 15 like the former embodiments, the needle threader member 142 is allowed to swing and goes into the status as shown in FIG. 16. At this time, the needle threader pin 148*b* of the needle threader part 148 is in the slit 152*c* of the protecting cover 152 (FIG. 19) and protected. The falling out stopper lugs 144*e* and 146*e* is about against the falling out stopper lugs 136*p* and 138*p*.

Figure 20:
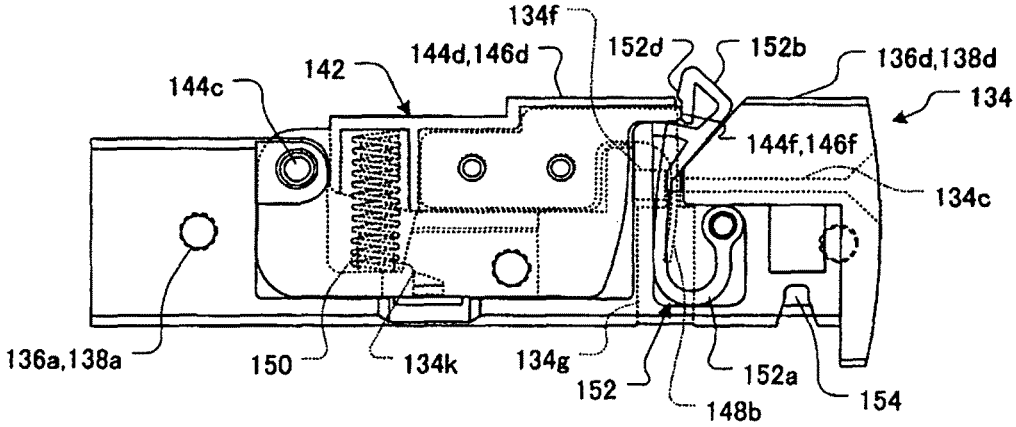
FIG. 20 is a lengthwise cross-sectional view of a main portion of the needle thread passing device of FIG. 15 at the time of use.

Then, the needle 52 is inserted into the needle insertion hole 134*c* with a needle eye 52*a* directed to the needle insertion hole 134*c*, and the thread 54 is inserted through the thread insertion slit 134*e*. Then, when the needle threader member 142 is pressed so as to allow the same to swing such that the tip ends 144*f* and 146*f* of the projecting parts 144*d* and 146*d* of the needle threader supporting parts 144 and 146 are brought close to the needle receiving member 134, the tip end of the needle threader pin 148*b* of the needle threader part 148 passes through the needle eye 52*a* while pressing the thread and reaches the thread pass hole 134*g* as shown in FIG. 20, enable the thread to pass through needle like the former embodiments.

When the needle threader member 142 swings, the needle threader pin 148*b* of the needle threader part 148 always passes through the inside of the slit 152*c* of the protecting cover 152, which restricts displacement of the both sides of the needle threader pin 148*b* by the slit 152*c* so as to prevent breakage or bent of the thin needle threader pin 148*b*. The protecting cover 152 may deform when the projecting parts 144*d* and 146*d* of the needle threader member 142 is approaching the needle receiving member 134, while protecting the needle threader pin 148*b*, so as not to prevent the needle threader member 142 from approaching the needle receiving member 134, and further prevent the inserted thread from escaping by means of blocking the thread insertion slit 134*e*. Further, the protecting cover 152 may prevent other thread from being inserted into the thread insertion slit 134*e*.

The tip ends 144*f* and 146*f* of the projecting parts 144*d* and 146*d* of the needle threader supporting parts 144 and 146 make contact with the small projection 152*d* of the protecting cover 152 at the fixed timing, of when just before or just after the needle threader pin 148*b* passes through the needle eye 52*a* (that is the needle insertion hole 134*c*). Thus, a clicking feel or a sound may be provided with the users so as to notify the users of the completion of the threadering.

Further, a projection or the like other than this small projection 152*d* may be provided at an optional position so as to notify the users of the completion of the threadering.

The invention claimed is:

1. A needle threader passing device comprising:

a needle receiving member formed with a needle insertion hole and a thread insertion slit forming an angle with the needle insertion hole;

a needle threader member that is movable between positions away from and close to the needle receiving member and has a needle threader pin that can push a thread inserted through the thread insertion slit into an eye of a needle inserted into the needle insertion hole when the needle threader member moves from the position away from the needle receiving member to position close thereto; and a changeover member that can move with respect to the needle receiving member, wherein the needle threader member is constantly biased toward the position away from the needle receiving member, wherein the changeover member can move between a locking position at which the needle threader member is locked to the position close to the needle receiving member and an allowable position at which the needle threader member is allowed to move between the positions away from and close to the needle receiving member, and wherein the needle threader member can swing so as to allow the tip end thereof to move between the positions away from and close to the needle receiving member, and the changeover member comprises a cover that covers at least a part of the needle threader member at the locking position.

2. A needle threader passing device comprising:

a needle receiving member formed with a needle insertion hole and a thread insertion slit forming an angle with the needle insertion hole;

a needle threader member that is movable between positions away from and close to the needle receiving member and has a needle threader pin that can push a thread inserted through the thread insertion slit into an eye of a needle inserted into the needle insertion hole when the needle threader member moves from the position away from the needle receiving member to position close thereto; and a changeover member that can move with respect to the needle receiving member, wherein the needle threader member is constantly biased toward the position away from the needle receiving member, wherein the changeover member can move between a locking position at which the needle threader member is locked to the position close to the needle receiving member and an allowable position at which the needle threader member is allowed to move between the positions away from and close to the needle receiving member, and wherein the needle receiving member is arranged in a cylindrical main body, the changeover member can be slid on the outside of the main body, and at least a part of the needle threader member is arranged in the main body when located at the position close to the needle receiving member.

3. The needle threader passing device according to claim 2, wherein a housing space is formed between the main body and needle receiving member.

4. A needle threader passing device comprising:

a needle receiving member formed with a needle insertion hole and a thread insertion slit forming an angle with the needle insertion hole;

a needle threader member that is movable between positions away from and close to the needle receiving member and has a needle threader pin that can push a thread inserted through the thread insertion slit into an eye of a needle inserted into the needle insertion hole when the needle threader member moves from the position away from the needle receiving member to position close thereto; and a changeover member that can move with respect to the needle receiving member, wherein the needle threader member is constantly biased toward the position away from the needle receiving member, wherein the changeover member can move between a locking position at which the needle threader member is locked to the position close to the needle receiving member and an allowable position at which the needle threader member is allowed to move between the positions away from and close to the needle receiving member, and wherein a magnet is arranged at the end portion of the needle insertion hole.

5. A needle threader passing device comprising:

a needle receiving member formed with a needle insertion hole and a thread insertion slit forming an angle with the needle insertion hole;

a needle threader member that is movable between positions away from and close to the needle receiving member and has a needle threader pin that can push a thread inserted through the thread insertion slit into an eye of a needle inserted into the needle insertion hole when the needle threader member moves from the position away from the needle receiving member to position close thereto; and a changeover member that can move with respect to the needle receiving member, wherein the needle threader member is constantly biased toward the position away from the needle receiving member, wherein the changeover member can move between a locking position at which the needle threader member is locked to the position close to the needle receiving member and an allowable position at which the needle threader member is allowed to move between the positions away from and close to the needle receiving member, and wherein the needle receiving member further includes a protecting member for guiding the movement of the needle threader pin.

6. The needle threader passing device according to claim 5, wherein the protecting member is deformable while the needle threader member approaches the needle receiving member so as to allow approach of the needle threader member.

7. A needle threader passing device comprising:

a needle receiving member formed with a needle insertion hole and a thread insertion slit forming an angle with the needle insertion hole;

a needle threader member that is movable between positions away from and close to the needle receiving member and has a needle threader pin that can push a thread inserted through the thread insertion slit into an eye of a needle inserted into the needle insertion hole when the needle threader member moves from the position away from the needle receiving member to position close thereto; and a changeover member that can move with respect to the needle receiving member, wherein the needle threader member is constantly biased toward the position away from the needle receiving member, wherein the changeover member can move between a locking position at which the needle threader member is locked to the position close to the needle receiving member and an allowable position at which the needle threader member is allowed to move between the positions away from and close to the needle receiving member, and wherein a notifying means for generating a sound or friction force is provided between the needle receiving member and the needle threader member in response to the needle threader pin of the needle threader member passing through the needle insertion hole.

8. A needle threader passing device comprising:

a needle receiving member formed with a needle insertion hole and a thread insertion slit forming an angle with the needle insertion hole;

a needle threader member that is movable between positions away from and close to the needle receiving member and has a needle threader pin that can push a thread inserted through the thread insertion slit into an eye of a needle inserted into the needle insertion hole when the needle threader member moves from the position away from the needle receiving member to position close thereto; and a changeover member that can move with respect to the needle receiving member, wherein the needle threader member is constantly biased toward the position away from the needle receiving member, wherein the changeover member can move between a locking position at which the needle threader member is locked to the position close to the needle receiving member and an allowable position at which the needle threader member is allowed to move between the positions away from and close to the needle receiving member, and wherein the needle threader member comprises a pair of needle threader supporting parts and a needle threader part including the needle threader pin arranged between the pair of needle threader support parts, one of the pair of the thread supporting parts having an axis pivotally supported by the needle receiving member and the other of the pair of the thread supporting parts having a cut out portion at a location corresponding to the axis.

9. The needle threader passing device according to claim 1, wherein the needle receiving member is arranged in a cylindrical main body, the changeover member can be slid on the outside of the main body, and at least a part of the needle threader member is arranged in the main body when located at the position close to the needle receiving member.

10. The needle threader passing device according to claim 1, wherein a magnet is arranged at the end portion of the needle insertion hole.

11. The needle threader passing device according to claim 2, wherein a magnet is arranged at the end portion of the needle insertion hole.

12. The needle threader passing device according to claim 1, wherein the thread insertion slit extends from the outside surface of the needle receiving member in the direction inclined with respect to the needle insertion hole, and then extends toward the needle insertion hole in the direction perpendicular to the needle insertion hole.

13. The needle threader passing device according to claim 2, wherein the thread insertion slit extends from the outside surface of the needle receiving member in the direction inclined with respect to the needle insertion hole, and then extends toward the needle insertion hole in the direction perpendicular to the needle insertion hole.

14. The needle threader passing device according to claim 4, wherein the thread insertion slit extends from the outside surface of the needle receiving member in the direction inclined with respect to the needle insertion hole, and then extends toward the needle insertion hole in the direction perpendicular to the needle insertion hole.

15. The needle threader passing device according to claim 1, wherein the needle threader passing device is constructed by integrating a needle threader unit and a unit having a different function from that of the needle threader unit, the needle threader unit including the needle receiving member, the needle threader member, and the changeover member.

16. The needle threader passing device according to claim 2, wherein the needle threader passing device is constructed by integrating a needle threader unit and a unit having a different function from that of the needle threader unit, the needle threader unit including the needle receiving member, the needle threader member, and the changeover member.

17. The needle threader passing device according to claim 4, wherein the needle threader passing device is constructed by integrating a needle threader unit and a unit having a different function from that of the needle threader unit, the needle threader unit including the needle receiving member, the needle threader member, and the changeover member.

18. The needle threader passing device according to claim 5, wherein a notifying means for generating a sound or friction force is provided between the needle receiving member and the needle threader member in response to the needle threader pin of the needle threader member passing through the needle insertion hole.

19. The needle threader passing device according to claim 8, wherein a notifying means for generating a sound or friction force is provided between the needle receiving member and the needle threader member in response to the needle threader pin of the needle threader member passing through the needle insertion hole.

20. The needle threader passing device according to claim 5, wherein the needle threader member comprises a pair of needle threader supporting parts and a needle threader part including the needle threader pin arranged between the pair of needle threader support parts, one of the pair of the thread supporting parts having an axis pivotally supported by the needle receiving member and the other of the pair of the thread supporting parts having a cut out portion at a location corresponding to the axis.

* * * * *